United States Patent [19]

Senda

[11] 3,958,543

[45] May 25, 1976

[54] PHOTOELECTRIC BREAKERLESS DISTRIBUTOR

[75] Inventor: Katsuyuki Senda, Toyota, Japan

[73] Assignee: Toyota Jidosha Kogyo Kabushiki Kaisha, Toyota, Japan

[22] Filed: Aug. 27, 1974

[21] Appl. No.: 500,876

[30] Foreign Application Priority Data

Apr. 5, 1974 Japan ..... 49-38660

[52] U.S. Cl. ..... 123/117 R; 123/146.5 A; 123/148 E; 200/31 CA

[51] Int. Cl.[2] ..... F02P 5/04

[58] Field of Search ..... 123/117 R, 146.5 A, 123/148 E; 200/31 CA, 80 R

[56] References Cited

UNITED STATES PATENTS

| | | | |
|---|---|---|---|
| 3,646,922 | 3/1972 | Spalding | 123/117 A |
| 3,710,131 | 1/1973 | Ford | 123/148 E |
| 3,751,610 | 8/1973 | Bednarz | 123/148 E |
| 3,792,261 | 2/1974 | Canup et al. | 123/148 E |
| 3,807,378 | 4/1974 | Wernet, Jr. | 123/148 F |
| 3,810,448 | 5/1974 | Ford | 123/32 EA |

FOREIGN PATENTS OR APPLICATIONS

| | | | |
|---|---|---|---|
| 71,823 | 2/1960 | France | 200/31 CA |

*Primary Examiner*—Charles J. Myhre
*Assistant Examiner*—Paul Devinsky
*Attorney, Agent, or Firm*—Stevens, Davis, Miller & Mosher

[57] ABSTRACT

There is provided an ignition system in which a light path is arranged so that the light output of a light emitting element is received by a photoelectric element, and this light path is made and broken intermittently to generate ignition signals. A plurality of weights or rockers are provided to intercept the passage of light in the light path. The weights are moved outward and inward by the centrifugal force which varies in accordance with the engine speed, and in this way the time interval during which the light is intercepted is varied. The duration of the light intercepting period is varied so that the dwell angle is increased as the engine speed increases. Consequently, even at the high engine speeds, the primary current in the ignition coil is not easily decreased thus preventing the decrease in the secondary voltage, and moreover the function of a centrifugal spark advance mechanism can be concurrently performed.

7 Claims, 12 Drawing Figures

FIG. 6

PHOTOELECTRIC BREAKERLESS DISTRIBUTOR

BACKGROUND OF THE INVENTION

1. Field of the Invention

The present invention relates to a spark ignition system for an internal combustion engine (hereinafter referred to as an engine).

2. Description of the Prior Art

Ignition systems are known in the art in which a current is supplied from a battery to the primary winding of an ignition coil and the contact points of a breaker connected in series with the primary winding are opened rapidly to induce a high tension voltage in the secondary winding of the ignition coil by the action of electromagnetic induction. This high voltage is applied across a spark plug to spark to ignite the mixture. With the conventional ignition systems, the primary current to the ignition coil is switched on and off by closing and opening the contact points of the breaker by a cam. The cam rotational angle in which the contact points are closed is called a dwell angle, and since this dwell angle is determined in accordance with the shape of the cam and the gap width of the contact points, the dwell angle does not depend on the engine speed and it is thus fixed. Consequently, the time during which the primary current flows into the ignition coil decreases in inverse proportion to an increase of engine speed. Since the rising characteristic of the primary current is fixed independently of the engine speed, the primary current flow decreases with the result that the primary current decreases as the engine speed gets higher and hence the secondary voltage decreases.

To overcome this difficulty, a method has been proposed in which the dwell angle is increased to increase the primary current. With the conventional ignition systems, however, if the gap width of the breaker contact points is reduced to increase the dwell angle, at the moment that the breaker contact points are opened an arc is produced between the contact points by the circuit inductance, so that the secondary voltage is decreased and hence the contact points are burnt out, thus deteriorating the ignition performance. Therefore, the method of reducing the gap width between the contact points cannot increase the dwell angle to any satisfactory extent.

Therefore, transistorized ignition systems have been proposed in which a transistor is employed to switch on and off the primary current of the ignition coil. In one form of these transistorized ignition systems, the angular position of the engine output shaft is detected by a suitable method, whereby a transistor into which the primary current is flowing is rendered nonconductive at a proper instant to switch off the primary current, and at the expiration of a predetermined time (a time $T_0$ in FIGS. 1 and 2) after the secondary voltage is generated causing a discharge at the spark plug, the transistor is again rendered conductive and the primary current again starts flowing into the transistor. In this case, since this system is not one in which the primary current is interrupted by the contact points, the dwell angle can be made considerably greater than one obtained in the conventional ignition systems.

However, as will be seen from a comparison between FIGS. 1 and 2, with transistorized ignition systems of the above type, the dwell angle is decreased at high engine speeds with respect to the dwell angle at low engine speeds. The time of flow of the primary current per unit period is longer at low engine speeds and this results in an increased quantity of heat generation in the ignition coil due to the primary current. Therefore, this conventional type of transistorized ignition system is not preferred, since the consumption of primary current and the generation of heat in the ignition coil are increased at low engine speeds.

It will thus be seen from the foregoing that an ignition system is preferred that ensures the dwell angle which is decreased at low engine speeds and which is increased at high engine speeds.

SUMMARY OF THE INVENTION

It is an object of the present invention to provide an improved ignition system wherein the dwell angle is increased as the engine speed is increased.

It is another object of the present invention to provide an ignition system which, in addition to increasing the dwell angle at high engine speeds, performs the function of a centrifugal spark advance mechanism.

In accordance with the present invention, there is thus provided an ignition system in which ignition signals are generated by making and breaking a light path arranged so that the light output of a light emitting element is received by a photoelectric element. The ignition system comprises a plurality of weights or rockers arranged to switch on and off the light output in the light path and adapted to be moved in rocking motion by the centrifugal force produced in accordance with the speed of the engine, whereby the weights are moved by the centrifugal force in such a manner that the portion of each weight which intercepts the passage of the light is varied to increase the dwell angle at high engine speeds.

The system according to the present invention has among its great advantages the fact that the primary current flow in the ignition coil is not easily decreased even at high engine speeds and thus the decrease in the induced secondary voltage is prevented.

Another great advantage of the system of this invention is that while, in the conventional ignition systems, the primary current flow in the ignition coil is increased at low engine speeds thus increasing the power consumption and making it difficult to cope with the problem of heat dissipation, the consumption of power is decreased during low speed operation of the engine to ensure decreased heat generation and improved resistance to heat.

Still another great advantage of the system is that the rockers are moved by the centrifugal force and therefore the function of a centrifugal spark advance mechanism is concurrently performed to eliminate the provision of any conventional centrifugal spark advance mechanism.

DESCRIPTION OF THE PREFERRED EMBODIMENTS

The present invention will now be described in greater detail with reference to the illustrated embodiments.

Figure 1:
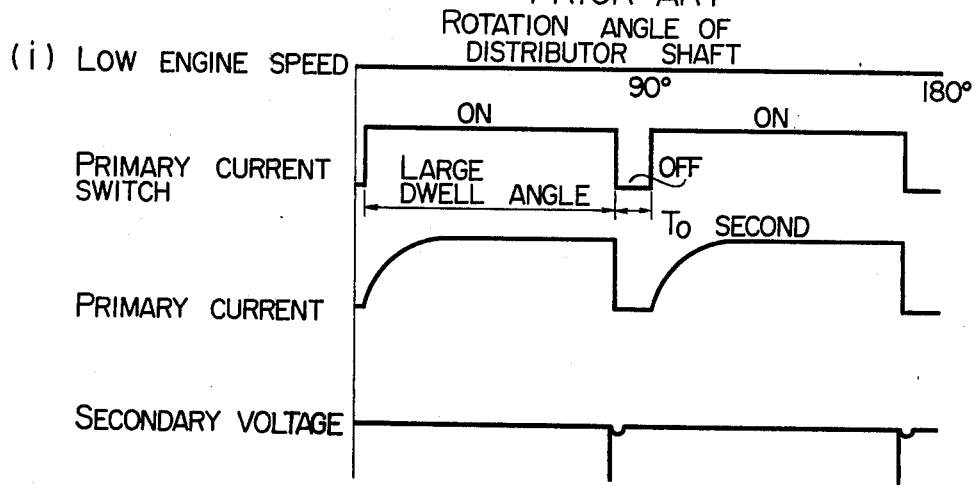
FIG. 1 PRIOR ART
FIG. 1 is a diagram showing the electric waveforms at various points in a prior art transistorized ignition system at a low engine speed.
Figure 2:
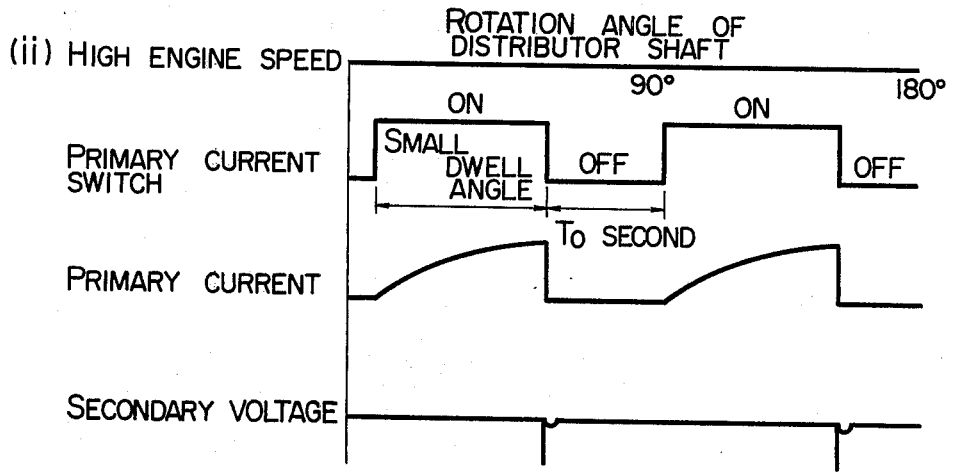
FIG. 2 PRIOR ART
FIG. 2 is a diagram showing the electric waveforms at various points in the prior art transistorized ignition system at a high engine speed.
Figure 3:
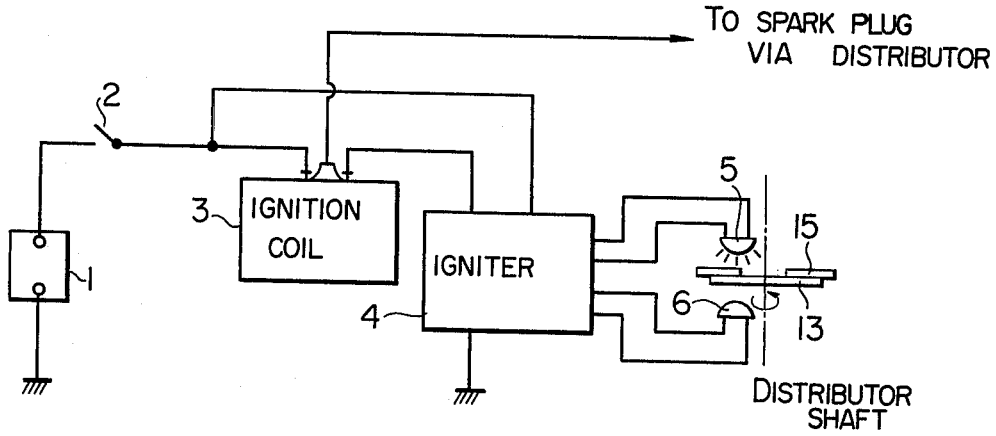
FIG. 3 is a schematic diagram showing an embodiment of an ignition system according to the present invention.

Referring first to FIG. 3, there is shown a schematic diagram of an embodiment of an ignition system of the invention. The current from a battery 1 is supplied to an ignition coil 3 and an igniter 4 through an ignition key 2. Numeral 5 designates a light emitting element such as a light emitting diode, 6 a photoelectric element such as a phototransistor. A photocoupler is constituted with the light emitting element 5 and the photoelectric element 6. Numeral 13 designates a rotary disk rotatable by the rotation of a distributor (not shown), and a plurality of weights 15 are mounted on the rotary disk 13. The rotary disk 13 and the weights 15 will be described in greater detail later. The light path of the photocoupler is intermittently blocked by the weights 15 mounted on the rotary disk 13. The ignition system is constructed so that ignition signals produced in response to the make and break of the photocoupler light path causes the igniter 4 to cut off the primary current flow to the ignition coil 3 at the instant the light path is blocked, thus inducing a secondary voltage in the ignition coil 3.

Figure 4:
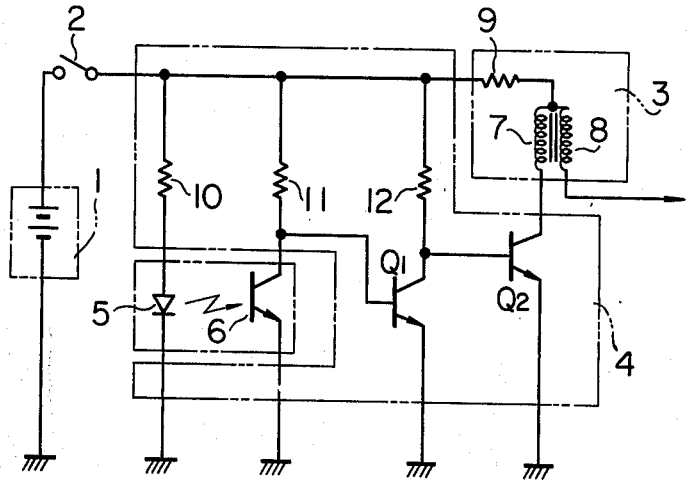
FIG. 4 is a circuit diagram for the embodiment of FIG. 3.

FIG. 4 illustrates a circuit diagram for the first embodiment of the ignition system according to the invention. In FIG. 4, the like reference numerals as used in FIG. 3 designate the same or like component parts. The photoelectric element 6 comprises a phototransistor. Designated as Q1 and Q2 are transistors. Numerals 7 and 8 designate respectively a primary coil and a secondary coil, 9, 10, 11 and 12 resistors.

In operation, when the light path of the photocoupler is blocked, the photoelectric element or phototransistor 6 is rendered nonconductive and thus the transistor Q1 is rendered conductive. Consequently, the transistor Q2 which is connected in series with the primary coil 7 of the ignition coil 3 to flow the primary current, is rendered nonconductive and the primary current flow is suddenly cut off, thus generating a high voltage in the secondary coil 8 of the ignition coil 3 by the action of electromagnetic induction. This high voltage is supplied to a spark plug (not shown) through the distributor rotor (not shown).

Figure 5:
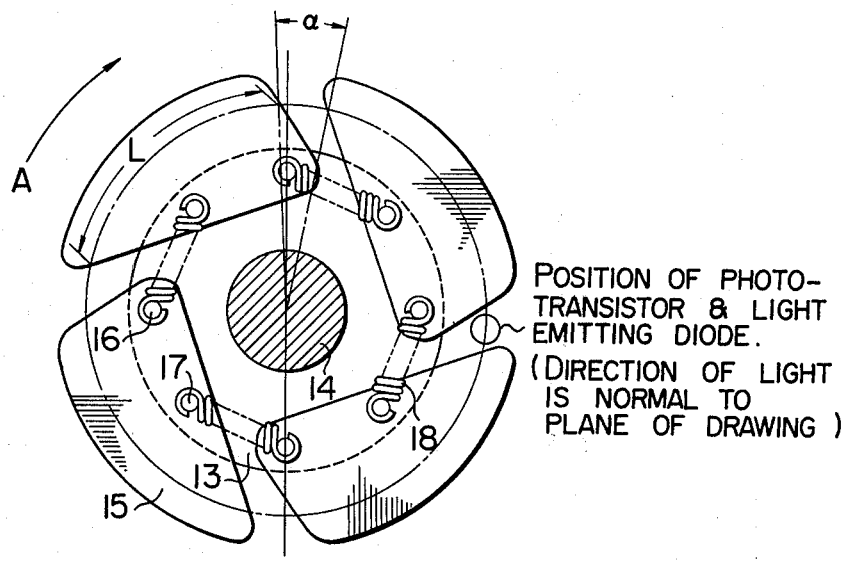
FIG. 5 is a plan view showing the principal component elements of the ignition system according to the invention.
Figure 6:
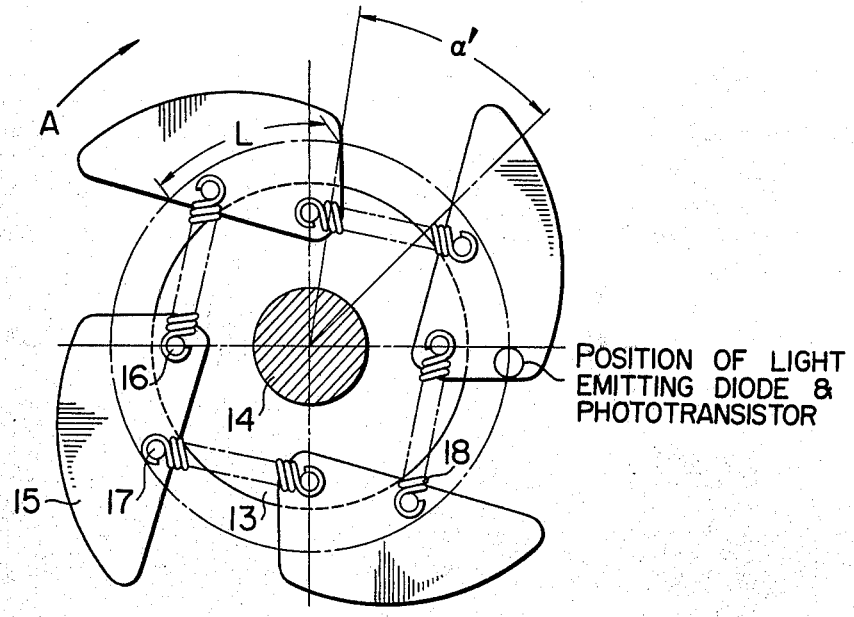
FIG. 6 is a plan view showing the operation of the component elements shown in FIG. 5 during the high speed operation of the engine.

FIGS. 5 and 6 are plan views showing the light path blocking mechanism constituting an important component element of the ignition system according to the invention which is used in the operation of a four-cylinder engine. FIG. 5 shows conditions in the light path blocking mechanism when the distributor shaft is rotated at a low speed, that is, when the engine is operated at a low speed, and FIG. 6 shows conditions in the light path blocking mechanism when the distributor shaft is rotated at a high speed, that is, when the engine is rotated at a high speed. In FIGS. 5 and 6, the rotary disk 13 is integrally mounted on a distributor shaft 14 so that it is rotatable along with the distributor shaft 14 in the direction of an arrow A in the illustration. Each of the weights 15 is mounted on the rotary disk 13 so that it is movable outward and inward about a fulcrum 16. Each of springs 18 is connected between the fulcrum 16 of each weight 15 and a pin 17 positional on the central portion of the preceding weight 15 in the direction of the rotation of the disk 13, so that when the weights 15 are thrown outward by the centrifugal force due to the rotation of the distributor shaft, the amount of their movement is limited. Here, the weight 15 is so shaped that the length of that portion of the weight 15 (the length L in FIGS. 5 and 6) which blocks the light path is gradually reduced as it is moved outward. Further, by virtue of the fact that the fulcrum 16 is provided in the inner front portion of the weight 15, the leading edge of the weight 15 in the rotational direction thereof is moved forward as it is thrown outward. The distributor housing (not shown) is provided with the light emitting element 5 and the photoelectric element 6 which are arranged on the sides of the weights 15 to face each other and thus form a photocoupler having a single light path. In other words, the light path is intermittently blocked in accordance with the rotation of the weights 15.

With the construction described above, the primary current flows in the ignition coil 3 only during the time when the light path of the photocoupler is not blocked by the weights 15.

In operation, as will be seen from a comparison between FIGS. 5 and 6, when the engine speed gets higher so that the weights 15 are thrown outward against the springs 18 by the centrifugal force, the area in which the light path is not blocked is increased from $\alpha$ in FIG. 5 to $\alpha'$ in FIG. 6. Namely, it will be understood that the dwell angle is increased as the engine speed is increased. Further, since the weights 15 are shaped in the manner described above, the timing for blocking the light path by the weights 15 is advanced as the engine speed is increased, thus automatically advancing the ignition timing. In other words, the light path blocking mechanism shown in FIGS. 5 and 6 is capable of concurrently performing the function of a centrifugal spark advance mechanism.

Figure 7:
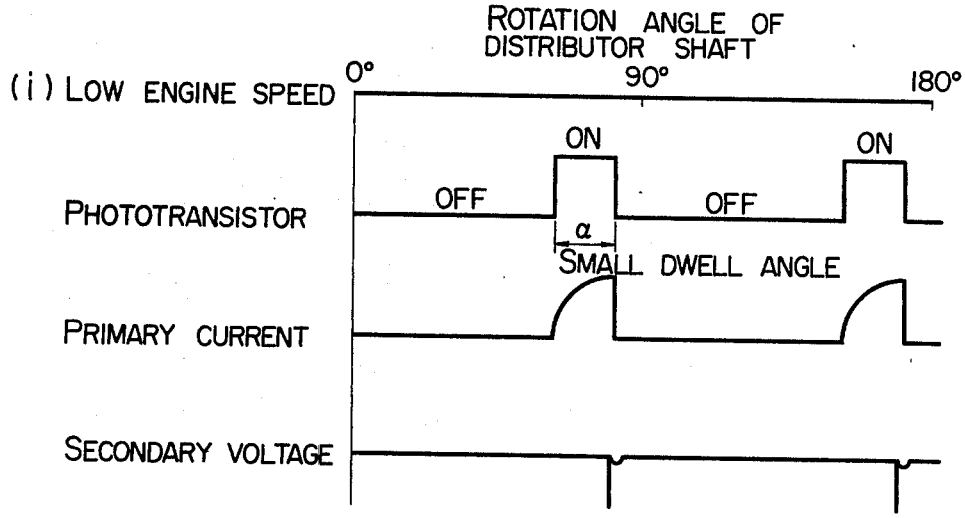
FIG. 7 is a diagram showing the electric waveforms generated at various points in the ignition system of the invention at low engine speed.
Figure 8:
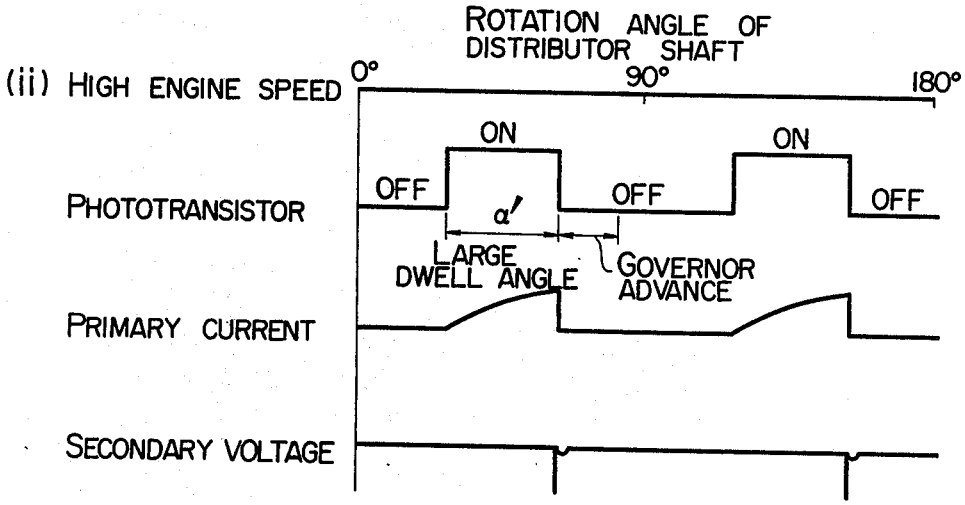
FIG. 8 is a diagram showing the electric waveforms generated at various points in the ignition system of the invention at high engine speed.

FIGS. 7 and 8 are waveform diagrams showing the waveforms of the current that flows through the phototransistor 6, the primary current and the secondary voltage of the ignition coil 3 in relation to the rotational angles of the distributor shaft in the ignition system of this invention. It will be seen from FIGS. 7 and 8 that when the rotational speed of the distributor shaft 14 is increased, that is, when the engine speed is increased, the dwell angle is increased and at the same time the spark advance is automatically adjusted.

Figure 9:
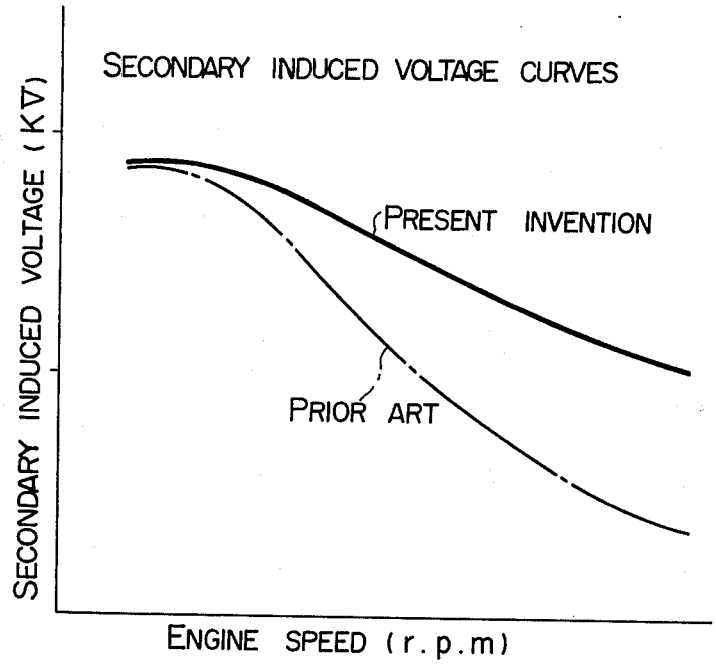
FIG. 9 is a graph showing the relationship between the engine speed and the secondary induced voltage.

FIG. 9 is a graph showing the relationship between the secondary induced voltage and the engine speed in the ignition system of this invention in comparison with a prior art ignition system employing a fixed dwell angle. It will be seen from FIG. 9 that in the ignition system according to the invention the drop in the secondary induced voltage at high engine speeds is small as compared with that in the conventional system.

Figure 10:
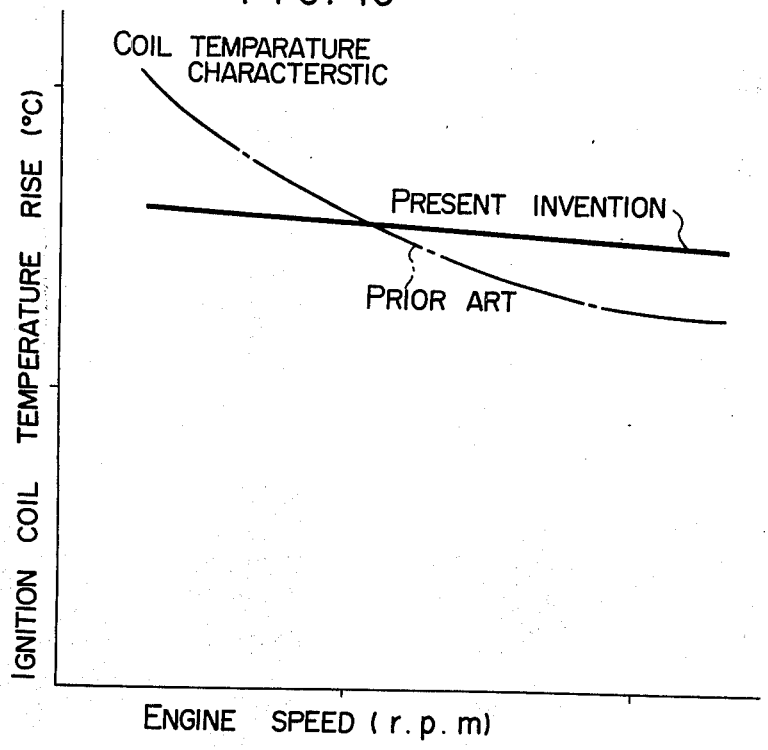
FIG. 10 is a graph showing the relationship between the engine speed and the temperature rise in the ignition coil.

In FIG. 10, there is illustrated a graph showing the relationship between the degree of temperature rise in the ignition coil and the engine speed in the ignition system of this invention in comparison with the conventional ignition system. It will be seen from FIG. 10 that while the ignition coil of the conventional ignition system shows a marked increase in the temperature at low engine speeds, the temperature rise in the ignition coil in the system of this invention is practically stable over the range of the engine speeds.

Figure 11:
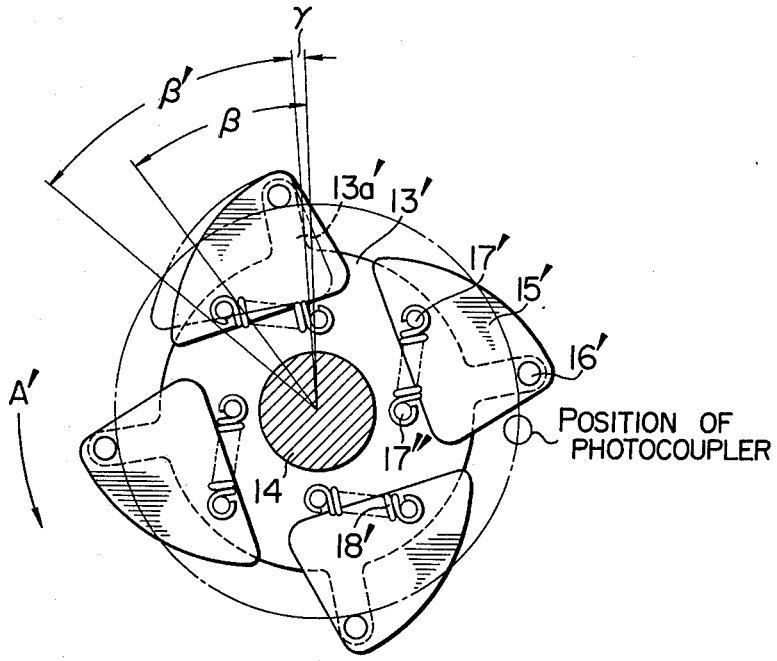
FIG. 11 is a schematic diagram showing another form of the principal component elements of the ignition system according to the invention.

The ignition system according to the above-described embodiment is constructed so that the primary current flow to the ignition coil is cut off when the light path of the photocoupler is blocked. However, the ignition system of this invention may be readily modified so that the primary current flows through the ignition coil when the light path of the photocoupler is blocked. In this case, the light path blocking mechanism may for example be constructed as shown in FIG. 11 to obtain the desired results. In FIG. 11, numeral 13′ designates a rotary disk, 13*a*′ a rotary disk arm, 14 the shaft of a distributor, 15′ weights mounted on the rotary disk 13′ so that each of the weights 15′ is movable outward and inward about a fulcrum 16′ provided at one end of each of the rotary disk arms 13*a*′ of the disk 13′. Numeral 17′ designates a pin fixedly mounted on the central portion of each of the weights 15′, 17″ pins fixedly mounted on the rotary disk 13′, 18′ a spring provided between the pins 17′ and 17″.

Figure 12:
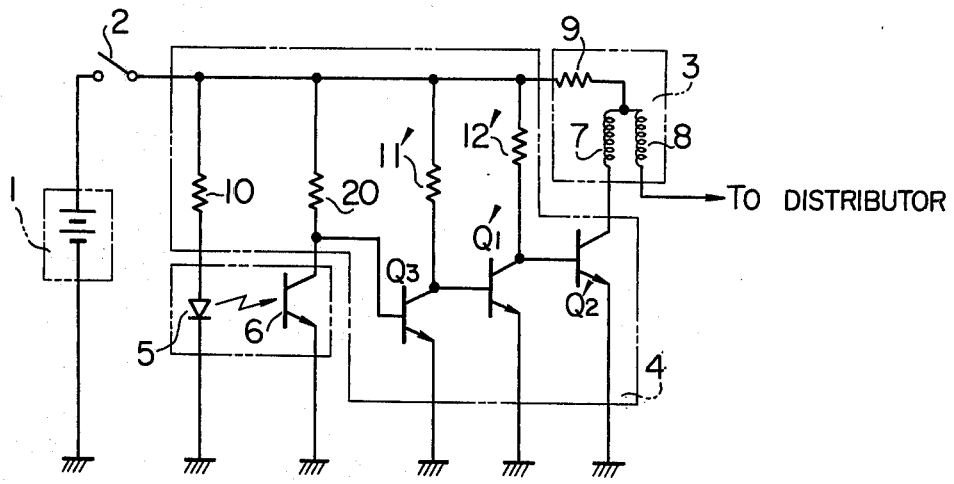
FIG. 12 is a circuit diagram of another embodiment of the invention employing the construction shown in FIG. 11.

In operation, when the engine is in motion, the distributor shaft 14 rotates in the direction of an arrow A′ in the illustration. When the engine is at low speed, the weights 15′ are in the positions indicated by the solid lines. Since the mechanism is constructed so that the primary current flows when the light path of the photocoupler is blocked by one of the weights 15′, the dwell angle at the low engine speed is indicated by $\beta$. When the engine speed gets higher, the weights 15′ are thrown outward against the springs 18′ by the centrifugal force and displaced into the positions indicated by the two-dot chain lines, for example. The dwell angle at this time is indicated by $\beta'$ and it is now greater than that at the low engine speed. Further, it will be seen that the shape of the weights 15′ and the position of the fulcrums 16′ are such that the trailing edges of the weights 15′ in the rotational direction thereof are advanced by $\gamma$ in the direction of rotation. Furthermore, the electric circuit for the second embodiment may be obtained by adding, as shown in FIG. 12, a resistor 20 and a transistor Q3 to the electric circuit of FIG. 4. In other words, with the construction shown in FIG. 11, a transistor Q2′ is switched from the conductive state to the nonconductive state at the instant that the photoelectric element or phototransistor 6 receives the light emitted by the light emitting element 5.

While the present invention has been described with reference to two specific embodiments in which the ignition system according to the invention is used in the operation of a four-cylinder engine, it should be apparent from the above-described teachings of this invention that many changes and modifications may be made by those skilled in the art without departing from the spirit and scope of the invention.

What is claimed is:

1. An ignition system for an internal combustion engine of the type in which at the instant when a light path provided by a light emitting element and a photoelectric element is blocked the flow of primary current to an ignition coil is cut off to generate a secondary voltage, said ignition system comprising:

a rotary disk fixedly mounted on the rotating shaft of a distributor and rotatable along with said distributor shaft;

a light emitting element and a photoelectric element mounted on said distributor for providing a light path outside the periphery of said rotary disk;

a plurality of weights pivotally mounted on said rotary disk to intermittently block said light path in accordance with the rotation of said rotary disk; and spring means for limiting the pivotal movement of said weights, wherein each of said plurality of weights is constructed in such a manner that said weight is thrown outward against the force of said spring means in accordance with an increase in the rotational speed of said distributor shaft, and the circumferential length of the portion of said weight that blocks said light path gradually varies in accordance with the outward movement of said weight.

2. An ignition system for an internal combustion engine of the type in which at the instant when a light path provided by a light emitting element and a photoelectric element is blocked the flow of primary current to an ignition coil is cut off to generate a secondary voltage, said ignition system comprising:

a rotary disk fixedly mounted on the rotating shaft of a distributor and rotatable along with said distributor shaft;

a light emitting element and a photoelectric element mounted on said distributor for providing a light path outside the periphery of said rotary disk;

a plurality of weights pivotally mounted on said rotary disk to intermittently block said light path in accordance with the rotation of said rotary disk; and spring means for limiting the pivotal movement of said weights, wherein each of said plurality of weights is constructed in such a manner that said weight is thrown outward against the force of said spring means in accordance with an increase in the number of revolutions of said distributor shaft, and the circumferential length of the portion of said weight that blocks said light path gradually reduces in accordance with the outward movement of said weight.

3. An ignition system for an internal combustion engine of the type in which at the instant when a light path provided by a light emitting element and a photoelectric element is made the flow of primary current to an ignition coil is cut off to generate a secondary voltage, said ignition system comprising:

a rotary disk fixedly mounted on the rotating shaft of a distributor and rotatable along with said distributor shaft;

a light emitting element and a photoelectric element mounted on said distributor for providing a light path outside the periphery of said rotary disk;

a plurality of weights pivotally mounted on said rotary disk to intermittently block said light path in accordance with the rotation of said rotary disk; and spring means for limiting the pivotal movement of said weights, wherein each of said plurality of weights is constructed in such a manner that said weight is thrown outward against the force of said spring means in accordance with an increase in the number of revolutions of said distributor shaft, and the circumferential length of the portion of said weight that blocks said light path gradually increases in accordance with the outward movement of said weight.

4. An ignition system according to claim 2, wherein the leading edge of each said weight in the direction of rotation thereof is adapted to be moved forward in said direction of rotation in accordance with the outward movement of said weight.

5. An ignition system according to claim 3, wherein the trailing edge of each said weight in the direction of rotation thereof is adapted to be moved forward in said direction of rotation in accordance with the outward movement of said weight.

6. An ignition system according to claim 4, wherein each of said weights is pivotally mounted on said rotary disk with a fulcrum at the inner forward portion of said weight, and said spring means comprises a plurality of springs each of which is connected between said fulcrum of each weight and a pin positioned on the central portion of the preceeding weight.

7. An ignition system according to claim 5, wherein each of said weights is pivotally mounted on a rotary disk arm projecting outward from said rotary with a fulcrum at outer backward portion of said weight, and said spring means comprises a plurality of springs each of which is connected between a pin mounted on the central portion of each of said weights and a pin fixedly mounted on said rotary disk.

* * * * *